United States Patent [19]

Barkley

[11] Patent Number: 5,020,807

[45] Date of Patent: Jun. 4, 1991

[54] PROJECTILE BOARD

[75] Inventor: Richard D. Barkley, Chesterville, Canada

[73] Assignee: Barkley-Harwood Ltd., Chesterville, Canada

[21] Appl. No.: 443,338

[22] Filed: Nov. 30, 1989

[30] Foreign Application Priority Data

Jun. 28, 1989 [CA] Canada ..... 604289

[51] Int. Cl.[5] ..... F41J 3/00

[52] U.S. Cl. ..... 273/409; D21/6

[58] Field of Search ..... 273/408, 409; D21/5, D21/6

[56] References Cited

U.S. PATENT DOCUMENTS 1,928,768 10/1933 Sell et al. ..... 273/409

FOREIGN PATENT DOCUMENTS 1575061 9/1980 United Kingdom ..... 273/409

2116053 9/1983 United Kingdom ..... 273/408

OTHER PUBLICATIONS

Playthings, 2-1977, Super Star Sports Games, Tom Weiskopf Golf.

*Primary Examiner*—Paul E. Shapiro

*Attorney, Agent, or Firm*—Dennison, Meserole, Pollack & Scheiner

[57] ABSTRACT

There is described a new and improved dart board comprising a generally flat target surface, a two-dimensional pattern of figures supported on the surface, the pattern emulating the holes of a golf course.

4 Claims, 1 Drawing Sheet

PROJECTILE BOARD

FIELD OF THE INVENTION

The present invention relates to a target game and more specifically to a new dart board having a novel pattern thereon representing a new target.

BACKGROUND OF THE INVENTION

Dart boards are of course known throughout the world and the pattern of the target on traditional dart boards has remained virtually unchanged over time. The traditional shape of the target remains popular, but when played in accordance with the generally accepted official rules of darts, the game makes no allowances for the differing levels of skill enjoyed by the players, with the result that many players, unable to, for example, double-out to end the game, simply make up their own informal rules. This results in a temporarily acceptable level of playing satisfaction, but eventually leads to disinterest, insofar as playing becomes meaningless.

SUMMARY OF THE INVENTION

It is an object of the present invention to obviate and mitigate from the disadvantages of the prior art.

It is a further object of the present invention to provide a new dart board that can be played by persons possessing differing levels of skill.

It is a further object of the present invention to provide a new dart board which emulates the rules of golf.

According to the present invention, then, there is provided a target comprising a generally flat target surface, a two-dimensional pattern of figures supported thereon, said pattern emulating the holes of a golf course.

BRIEF DESCRIPTION OF THE DRAWINGS

Embodiments of the invention will now be described in greater detail and will be better understood when read in conjunction with the following drawings, in which.

DETAILED DESCRIPTION

Figure 1:
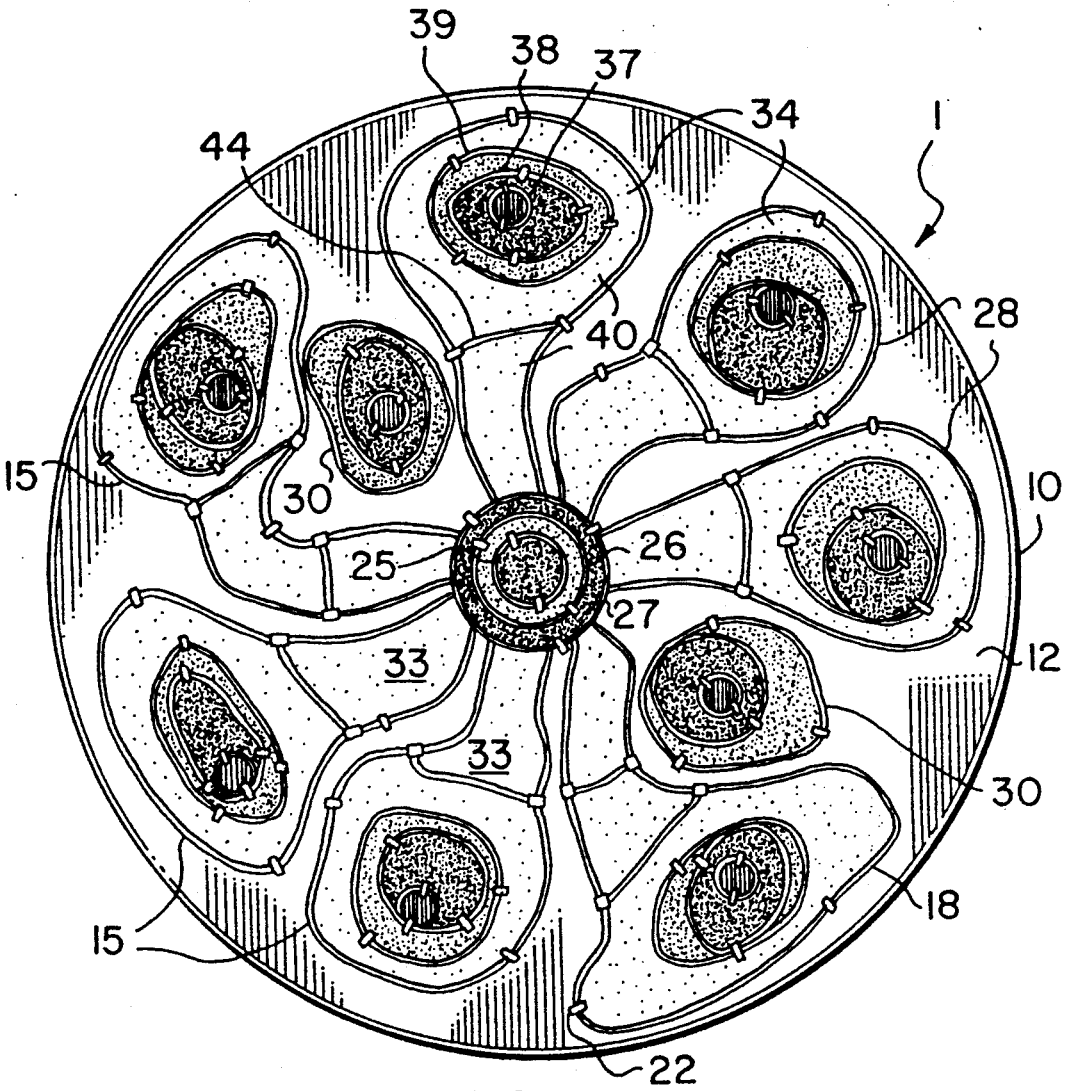
FIG. 1 is a frontal view of the target surface of the present dart board.
Figure 2:
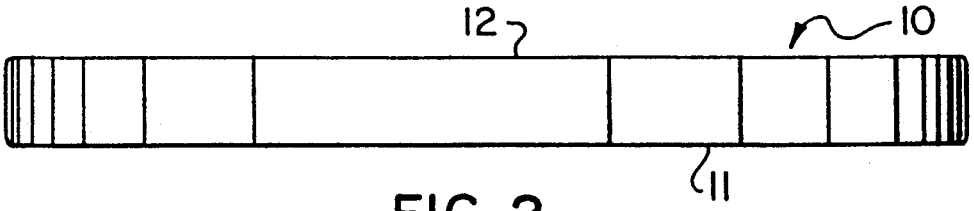
FIG. 2 is a side elevational view of the dart board of FIG. 1.

With reference to FIGS. 1 and 2, dart board 1 comprises a cylindrical disc 10 having a flat rear surface 11 and a frontal, generally flat, target surface 12. Surface 12 supports thereon a pattern of FIGS. 15 making up the target of the present board. As with traditional dart boards, FIGS. 15 may be defined by flexible wires 18 bent to the required shapes and secured to the surface 12 by means of fasteners 22 of any known suitable types such as staples.

FIGS. 15 include in the embodiment as shown at least one but preferably three centrally located concentric rings 25, 26 and 27 defining a bullseye, a plurality of irregularly-shaped closed loops 28 extending radially from outer ring 27 and at least one but more preferably two or more closed floating loops 30 disposed between adjacent ones of loops 28. As will be seen particularly from FIG. 1, each of loops 28 has a relatively narrow inner or neck portion 33 which widens out into a more bulbous portion 34. Each portion 34 includes therein at least one but preferably a plurality of rings 37, 38 and 39. Some of loops 28 are further subdivided into segments 40 by means of a fairway divider 44 consisting of a short piece of the same wire used to define the figures of the target.

The pattern of figures as shown is intended to emulate a nine hole golf course with each of FIGS. 28 representing either a par 4 or a par 5 hole, and loops 30 each representing a par 3. The portion of each loop between wire 18 and outer ring 39 represents a fairway. The area within ring 39 represents either green or a combination of green and a hazard, depending on the level at which the game is being played. Areas outside the loops represent rough with the bullseye being available for plays as an alternate to the greens within loops 39. The smallest rings 25 and 37 represent the cups.

In use, the players will attempt to complete the "course" at or below par, each player's score, counted in strokes, corresponding to the number of darts thrown to complete the course in accordance with the rules of play.

I claim:

1. A target for darts comprising a generally flat target surface, a two-dimensional pattern of figures supported thereon to emulate the holes of a golf course, said pattern comprising:

a plurality of concentric rings centrally located on said target's surface;

a plurality of irregularly shaped non-abutting closed loops radiating outwardly from said concentric rings at spaced points thereabout and defining fairways with an irregularly shaped undivided rough surrounding and separating said fairways outward of said concentric rings; and at least one closed floating loop spaced from said concentric rings in said rough between adjacent ones of said closed radiating loops, said closed radiating loops being additionally subdivided into at least two segments, namely an innermost segment adjacent said concentric rings, and an outermost segment remote from said concentric rings, each of said closed radiating loops including at least one smaller closed loop solely in the outermost segment thereof and representing a golf green.

2. The target of claim 1, wherein selected ones of said closed radiating loops are divided into two segments, and others of said closed radiating loops are divided into three segments.

3. The target of claim 1 wherein each of said radiating loops is relatively narrow adjacent said concentric rings and widens outwardly therefrom into a bulbous shape.

4. The target of claim 3 wherein the bulbous shapes of said radiating loops encircle said concentric rings with each bulbous shape including one of said at least one smaller closed loop.

* * * * *